US009372052B2

(12) United States Patent
McGeehan

(10) Patent No.: US 9,372,052 B2
(45) Date of Patent: Jun. 21, 2016

(54) SYSTEM AND METHOD FOR DECOY MANAGEMENT

(71) Applicant: Timothy P. McGeehan, Virginia Beach, VA (US)

(72) Inventor: Timothy P. McGeehan, Virginia Beach, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/326,545

(22) Filed: Jul. 9, 2014

(65) Prior Publication Data

US 2016/0010952 A1 Jan. 14, 2016

(51) Int. Cl.

| | |
|---|---|
| ***F41G 7/22*** | (2006.01) |
| ***F41J 9/08*** | (2006.01) |
| ***F41G 7/00*** | (2006.01) |

(52) U.S. Cl.

CPC ..... *F41G 7/224* (2013.01); *F41G 7/007* (2013.01); *F41J 9/08* (2013.01)

(58) Field of Classification Search

CPC ..... G06F 21/554; G06F 21/566; F41H 11/02; F41J 9/10; H04L 63/1408; H04L 63/1491

USPC ..... 701/3, 300; 702/188; 713/201; 726/3, 726/22, 24; 250/370.11; 102/336, 337; 244/1 TD; 89/1.11; 114/312

See application file for complete search history.

(56) References Cited

U.S. PATENT DOCUMENTS

| | | | | |
|---|---|---|---|---|
| 5,099,128 | A * | 3/1992 | Stettner | G01S 17/89 250/363.06 |
| 6,230,629 | B1 * | 5/2001 | Doctor | F42B 4/28 102/337 |
| 2004/0172557 | A1 * | 9/2004 | Nakae | H04L 63/0227 726/22 |
| 2005/0222820 | A1 * | 10/2005 | Chung | G08B 13/19645 702/188 |
| 2006/0065774 | A1 * | 3/2006 | Roques | B64D 39/00 244/1 TD |
| 2007/0234922 | A1 * | 10/2007 | Van Laar | F41J 2/00 102/336 |
| 2009/0000465 | A1 * | 1/2009 | Deflumere | F41H 11/02 89/1.11 |
| 2010/0077483 | A1 * | 3/2010 | Stolfo | G06F 21/554 726/24 |
| 2010/0269175 | A1 * | 10/2010 | Stolfo | G06F 21/55 726/22 |
| 2013/0124015 | A1 * | 5/2013 | Pangilinan | G08G 5/0021 701/3 |
| 2013/0160079 | A1 * | 6/2013 | Hebert | H04L 63/1491 726/3 |
| 2013/0179063 | A1 * | 7/2013 | Herman | G01S 11/02 701/300 |
| 2013/0298819 | A1 * | 11/2013 | Jung | F42B 10/42 114/312 |

* cited by examiner

*Primary Examiner* — Jerrah Edwards
*Assistant Examiner* — Sanjeev Malhotra
(74) *Attorney, Agent, or Firm* — US Naval Research Laboratory; Richard F. Bis

(57) ABSTRACT

System and method for determining which decoys should not be deployed based on the locations of the nearby high value units and other considerations. The system and method can visualize and manage the employment of decoys in a multi-platform environment by plotting the predicted path of decoys relative to high value unit (HVU) motion, and highlighting any situations that exist where the decoys (both air-drifting and self-propelled) launched from a platform can direct an incoming threat towards a high value unit. The system and method can develop, display, and automatically transmit a recommendation to launch or not launch a specific decoy.

17 Claims, 8 Drawing Sheets

SYSTEM AND METHOD FOR DECOY MANAGEMENT

CROSS-REFERENCE TO RELATED APPLICATIONS

None.

BACKGROUND

Methods and systems disclosed herein relate generally to decoys, including both air-drifting and self-propelled variants, simulated and actual. A decoy launched to deflect a threat from the launch platform of the decoy, or other high value units (HVUs) in the vicinity of the launch platform, to the decoy. However, when a decoy is deployed from the launch platform, the decoy could make other platforms or HVUs themselves targets. Air-drifting decoys can drift with the true wind for a period of time while self-propelled decoys fly based on other parameters (a separation velocity from the launch platform, for example). Tracking the relative movements of decoys from a single launch platform is possible by, for example, manually plotting the movement of the decoys with a maneuvering board, dividers, ruler, and pencil. Variables that can affect the motion of the decoys can include the launch platform course and speed, wind direction and speed, lifetime of air-drifting decoys, and decoy parameters of self-propelled decoys. The problem becomes more complex with the inclusion of a HVU in the vicinity of the launch platform. The launch platform needs to ensure that it does not put any decoys in a position to drift near the HVU itself or near the "fly up/fly through" (FU/FT) line (a line extending from the direction of a possible incoming threat, through the HVU position, and continuing past the HVU). A decoy crossing this line—ahead of or behind the HVU—could seduce a threat such as, for example, but not limited to, a missile towards the HVU. This is known as a "fly up/fly through" situation.

To further complicate the situation, there could be multiple platforms—ships or aircraft—launching decoys simultaneously. In simple situations, visualization can be used for the management of the decoys. An operator can visualize the relative location and motion of the air-drifting decoys, (a function of the wind speed and direction, HVU course and speed, launch platform range and bearing from HVU at launch time, and time) as well as the flight trajectories of the self-propelled decoys (a function of the HVU course and speed, launch platform range and bearing from HVU at launch time, launch platform course and speed at launch time, threat bearing, and time). In the more complicated situation in which there are multiple decoys, multiply decoy launch platforms, multiple HVUs, and multiple threats, human operator management of decoys by visualization or any other means, especially human operator computation of the location of the decoys, is impossible because of the number of variables and their rate of change. Such a situation, for example when HVUs and launch platforms are maneuvering frequently, could require constant revision and iteration to adjust course, speed, range or bearing variables.

Existing methods for decoy management are slow and inflexible. In a scenario in which decoys are being launched in a combat situation, the human operator charged with managing the decoys may also have multiple other demands on her/his time. Further, managing decoys manually can require significant training and practice, with multiple steps allowing multiple opportunities for error in determining vulnerabilities in the current formation where decoys could move to positions that could endanger the HVU. Ultimately, the human operator needs to determine which launch platforms should refrain from launching which decoys, or where launch platforms could move to clear up any dangerous situation. When time is of the essence and accuracy matters, there are simply too many constantly changing variables for a human operator to effectively manage decoys without automated assistance. Further considerations in decoy management can include, but are not limited to, (1) tactics and doctrine, (2) visualizing, planning, and managing false force presentation through the use of air drifting decoys (such as chaff), (3) preventing foreign object debris from landing on ships, leading to aircraft engine failure, (4) managing deployment of smoke obscurants to visually hide a vessel, (5) avoiding hazardous plumes, and (5) air dropping to a moving target.

What is needed is a system that reduces or eliminates a human operator's workload. At most, a human operator should be required to input a few numbers. Numerous time-consuming calculations should be executed automatically, their interactions and the iterative nature of constantly updating variables associated with decoy management as stated above should be instantly providing the operator at least a complete and clear graphical picture to heighten her/his situational awareness, preferably a launch/no launch directive transmitted automatically to the launch platforms in real time. What is further needed is that the system automatically computes a graphical solution at various range scales, allowing the operator to adjust to view the situation/formation laydown. Finally, the training and practice required to achieve proficiency should be reduced to minutes.

SUMMARY

The system and method of the present embodiment can determine which decoys should not be deployed based on the locations of the nearby high value units and other considerations. The system and method of the present embodiment for visualizing and managing the employment of decoys in a multi-platform environment can (1) plot the predicted path of decoys relative to HVU motion, and (2) highlight any situations that exist where the decoys (both air-drifting and self-propelled) launched from a platform, for example, but not limited to, ship or aircraft, could potentially place the HVU in danger by distracting or seducing an incoming threat into the path of the HVU. The system and method of the present embodiment can develop, display, and automatically transmit a recommendation to launch or not launch a specific decoy.

The system and method of the present embodiment can automatically analyze the platform formation to detect and mitigate instances of potential fratricide. These detected instances of potential fratricide can be, for example, automatically highlighted on a graphic display to draw the operator's attention and show the operator exactly which platform must be moved or directed to abort decoy launch. Actionable recommendations can be automatically generated to mitigate the potential fratricide situations. For example, directive text orders can appear on the screen for the operator to read and broadcast over the radio, or specific commands can be automatically transmitted to launch platforms automatically. The system and method can facilitate simulations so that various possible scenarios can be evaluated quickly. Simulations could be done in the mission planning phase to prevent the possible fratricide situation from developing in the first place, or in real time to create new stationing assignments to resolve a potentially dangerous situation.

DETAILED DESCRIPTION

Figure 1:
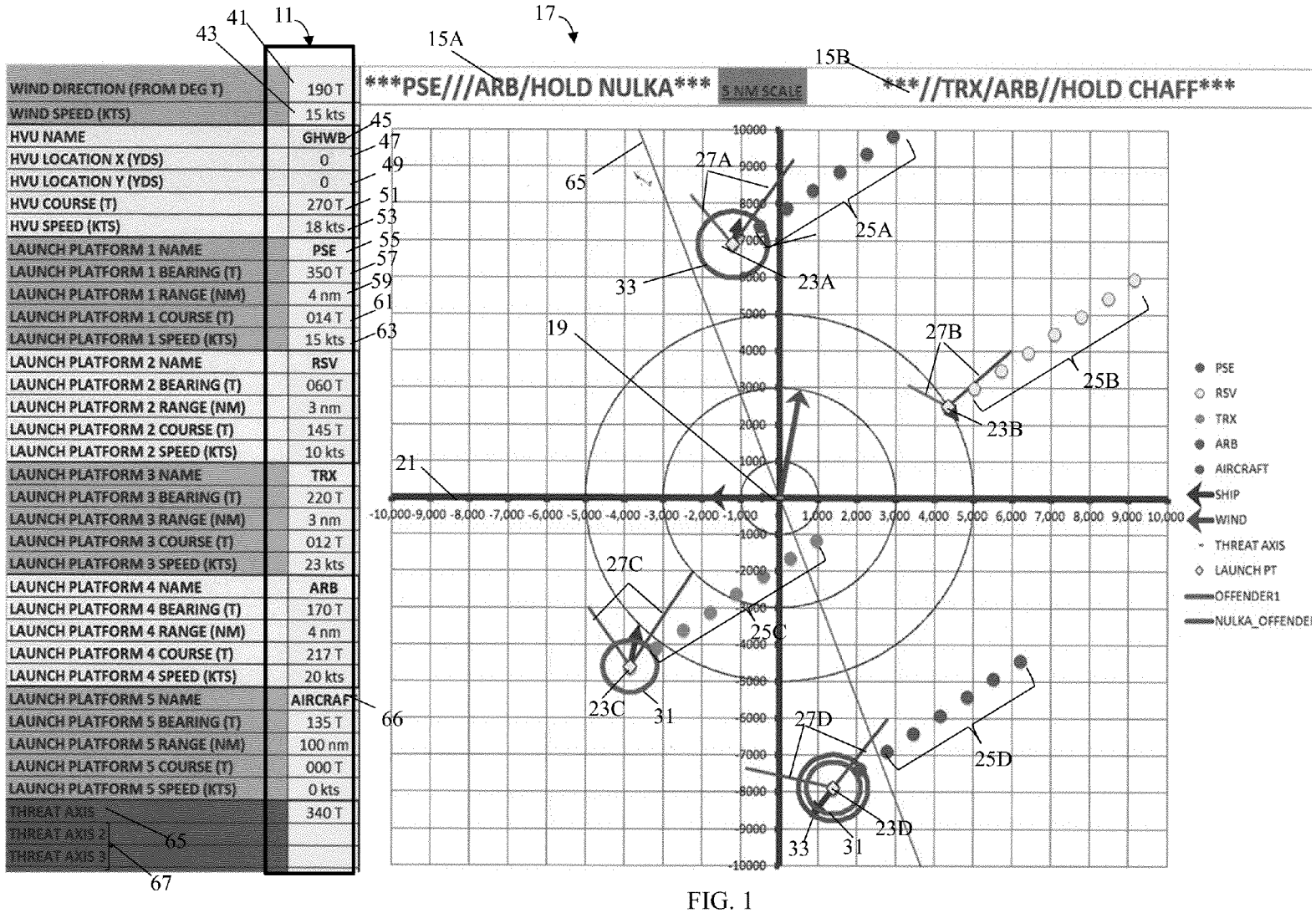
FIG. 1 is graphical display of the output of one embodiment of the present teachings.
Figure 2A:
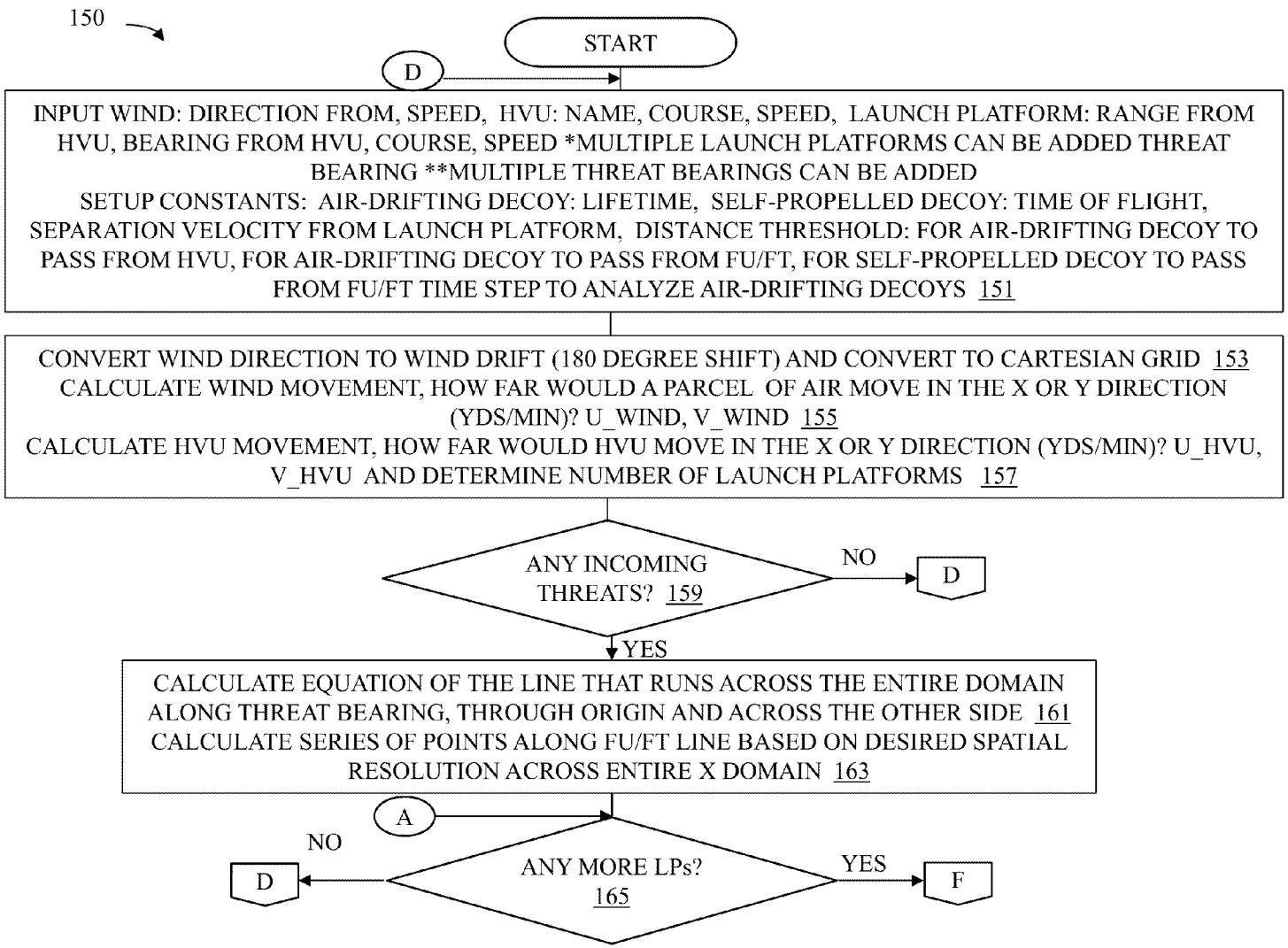
FIGS. 2A-2D are flowcharts of the method of one embodiment of the present teachings.
Figure 2B:
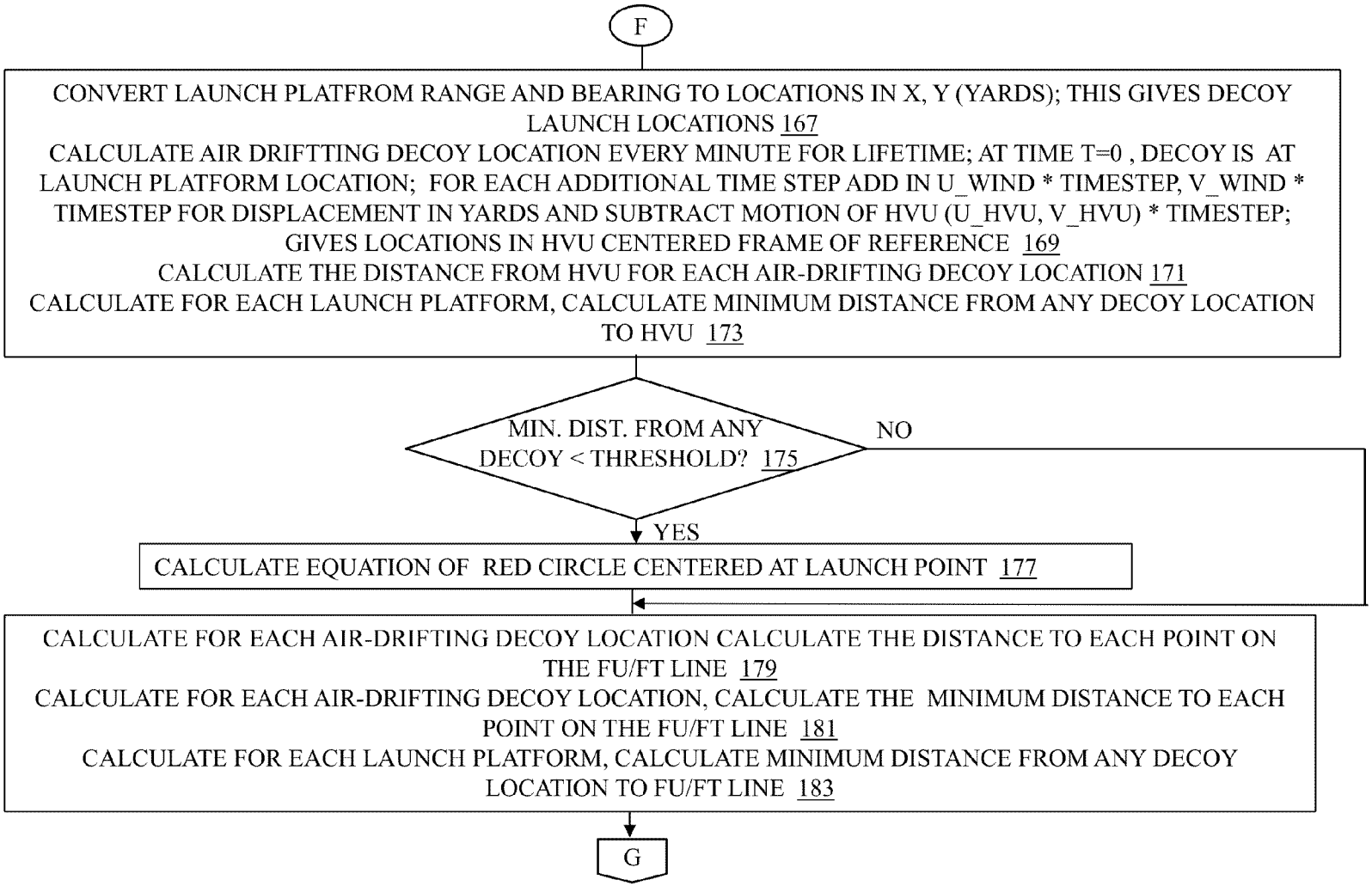
Figure 2C:
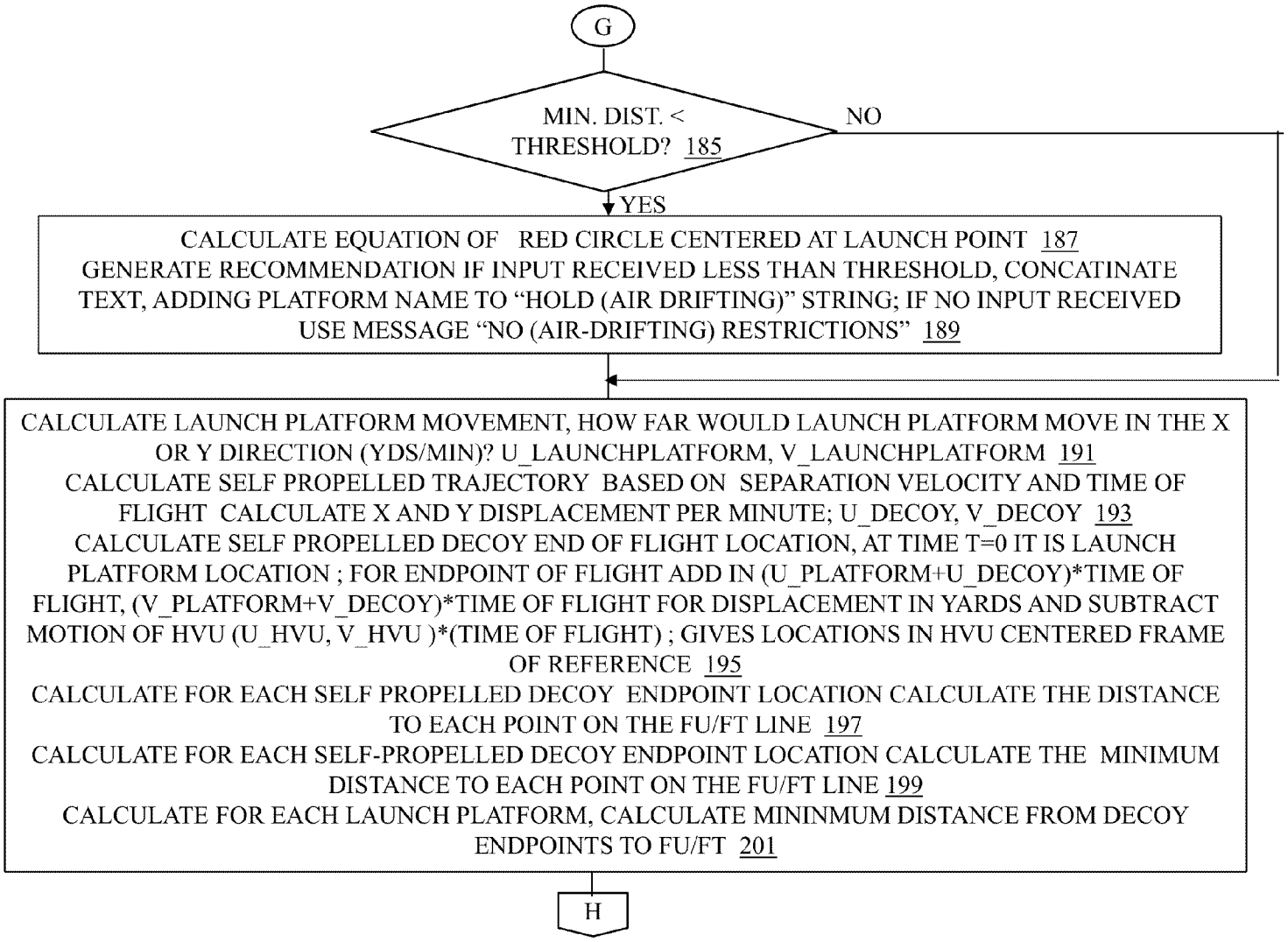
Figure 2D:
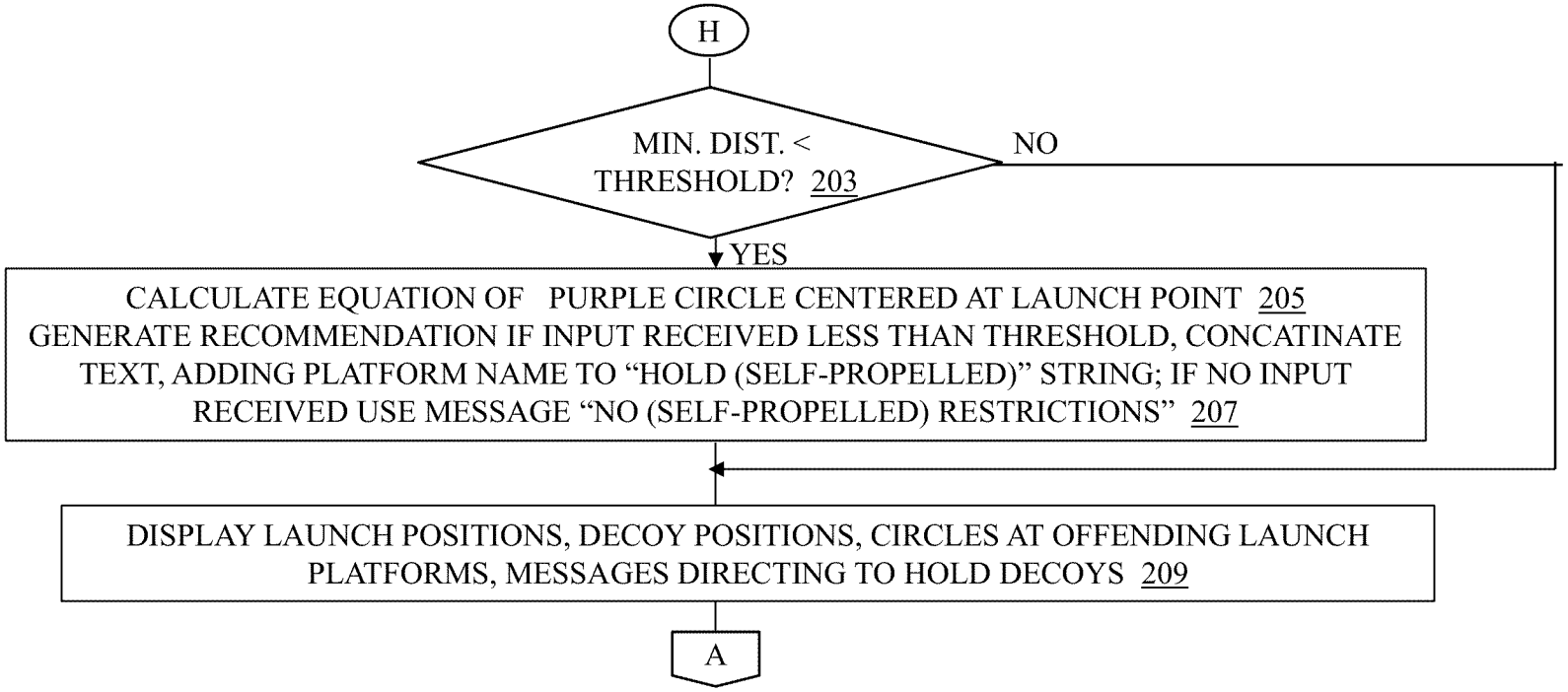

The problems set forth above as well as further and other problems are solved by the present teachings. These solutions and other advantages are achieved by the various embodiments of the teachings described herein below. The system and method of the present embodiment automatically track the potential movements of decoys—both air-drifting and self-propelled—as they move relative to HVUs in the vicinity, and can cause deployment of the decoys to be aborted. The system and method can execute on a small shipboard device, or can be scaled up to include ever-increasing amounts of automation. The system and method calculate the minimum distance from the decoy's projected trajectory to one or more HVUs, and also the minimum distance from the decoy's projected trajectory to the fly up/fly through FU/FT line if a threat bearing is available. If air-drifting decoys are predicted to pass closer than a pre-determined distance from either the HVU itself or the fly up/fly through line, the system and method can either create a warning display such as a circle around the launch platform and a radio command, and/or can automatically abort the decoy deployment. Likewise, the system and method can calculate the minimum distance from the endpoints of possible self-propelled decoy flights to the FU/FT line. If the minimum distance falls closer than a pre-set threshold distance, the system and method can create warn the operator, and/or can automatically abort the decoy launch, or take other action.

The system and method can compute and/or receive input such as, for example, but not limited to, lifetime of the air-drifting decoys, time of flight and separation velocity for self-propelled decoys, air-drifting decoy minimum distance to HVU and FU/FT line, and self-propelled decoy minimum distance to FU/FT line. A user interface can allow data entry for routine operation such as, for example, but not limited to, formation of launch platforms—name, course, speed, range, and bearing from HVU, HVU information—course and speed, wind direction and speed, and threat bearing (if specified). A visualization can show the formation laydown, threat bearing, where the launch points are, where the air-drifting decoys will move in 1 minute intervals, and where the self-propelled decoys will fly. For each platform launching air-drifting decoys, the system and method can calculate the minimum distance from the decoy's trajectory to HVU itself, and also the minimum distance from the decoy's trajectory to the FU/FT line if a threat bearing is specified. If the air-drifting decoys will pass closer than a pre-determined distance, which can, but is not limited to being, entered during setup, from either the HVU itself or the FU/FT line, the system and method can plot a red circle around the launch platform on the display. Additionally, a message can appear at the top of the graphic, for example, in red print, with the command that a watchstander could pass on the radio to negate the decoy launch from all offending platforms (for example, "PSE HOLD CHAFF"). Likewise, the system and method can calculate the minimum distance from the endpoints of possible self-propelled decoy flights to the FU/FT line. If this falls closer than a pre-set threshold distance, the system and method can plot, for example, but not limited to, a purple circle around the launch platform on the display. Additionally, a message can appear at the top of the graphic, for example, in purple print, with the command the watchstander could pass on the radio to negate self-propelled decoy launches from all offending platforms (for example "TRX/RSV HOLD NULKA").

Referring now to FIG. 1, routine operation data 11 can include, but are not limited to including, wind direction 41, wind speed 43, HVU name 45, HVU x location 47, HVU y location 49, HVU course 51, HVU speed 53, launch platform 1 (LP1) name 55, LP1 bearing 57, LP1 range 59, LP1 course 61, and LP1 speed 63. In the example shown in FIG. 1, LP2 23B, LP3 23C, and LP4 23D fields have the same meaning as LP1 fields listed previously. LP5 66 is a platform without self-propelled decoys, therefore it is for a platform such as, for example, but not limited to, an aircraft or a ship, that can only deploy air-drifting decoys. In this example, wind direction 41 is the true wind measured in degrees True (T), wind speed 43 is the true wind speed measured in knots, and HVU name 45 is a trigraph for the naming HVU 19. In this example, HVU location x 47 and HVU location y 49 are set and locked at 0 yards, making HVU 19 always the center of the display and everything shown relative to it. Other embodiments are possible. HVU course 51 is the course of HVU 19 measured in degrees T. HVU speed 53 is the speed of HVU 19 measured in knots. LP1 name 55 is the trigraph for ship that can launch air-drifting decoys. LP1 bearing 57 is measured in degrees T, from HVU 19 to the LP1 23A. LP1 range 59 is the range from the HVU 19 to LP1 23A measured in nautical miles (nm). If a launch platform is not needed, it can be removed from the display by making LP range 59 a large number (i.e. 100 nm), removing the launch platform from the display screen. LP range 59 may be used to position LP1 23A coincident with another launch platform or HVU 19, even though such a position is not physically possible. Some embodiments may forbid such a configuration. LP1 course 61 is the true course of the launch platform measured in degrees T. LP1 speed 63 is the true speed of LP1 23A measured in knots. LP2 23B, LP3 23C, and LP4 23D can include the same characteristics as LP1 23A. LP5 66 can also include the same characteristics as LP1 23A-LP4 23D, although LP5 66 is limited to air-drifting decoys since it is shown to be an aircraft. Threat axis 65 (also referred to herein as FU/FT line 65) is the threat bearing measured by HVU 19 in degrees T and is referenced by the self-propelled decoy. Threat axis-2, -3, . . . are reference lines 67. The air-drifting decoy minimum distance to HVU 19 is determined, for example, but not limited to, during setup and can be, but is not limited to being, locked at a specified distance based on the threshold of how close is it acceptable to have air-drifting decoys pass from HVU 19. The air-drifting decoy minimum distance to FU/FT line 65 can be, for example, but not limited to, entered during setup and locked at a specified distance based on the threshold of how close it is acceptable to have air-drifting decoys pass from FU/FT line 65. The self-propelled decoy minimum distance to FU/FT line 65 can be, for example, but not limited to, entered during setup and locked at a specified distance based on the threshold of how close is it acceptable to self-propelled decoys pass from FU/FT line 65. The air-drifting decoy minimum distance to FU/FT could also cover the air-drifting decoy minimum distance to HVU since the FU/FT line goes through the HVU position (0,0). The display of FIG.1 can be zoomed in or out. Zooming options can be, but are not limited to being, 5 nm, 10 nm, 15 nm, and 20 nm.

Once threat axis 65 is determined, the system and method can provide visual notification, for example, about what actions launch platforms should or should not take, for example, hold fire for the self-propelled decoy 15A, or hold fire for the air-drifting decoy 15B. If there are no restrictions a message could be displayed to that effect (for example "*NO NULKA RESTRICTIONS*" or "*NO CHAFF RESTRICTIONS*"). These visual notifications can be used to give the operator a quick text for what to pass over the radio, thus distilling the necessary information for when the operator is task loaded and doesn't have time for analysis of the graphical display.

Continuing to refer to FIG. 1, graph 17 is oriented north up (000T), with the HVU 19 fixed in the center at point (0,0). Axes values 21 are shown in yards because the decoy miss distances can be very small. LP1 23A, LP2 23B, LP3 23C, and LP4 23D indicate launch platform positions at launch time 0. Dot strings 25A, 25B, 25C, and 25D represents the air-drifting decoy locations in one-minute intervals until they dissipate. Lines 27A, 27B, 27C, and 27D are possible self-propelled decoy trajectories. Multiple threat axes 65 can be entered for reference. Air-drift hold circles 31 indicate which launch platforms should not release air-drifting decoys because they would pass too close to HVU 19 or FU/FT line 65. Self-propelled hold circles 33 indicate which launch platforms should not launch self-propelled decoys because the endpoint of the flight is too close to the FU/FT line.

Referring now to FIGS. 2A-2D, method 150 for managing decoys can include, but is not limited to including, determining 151, either automatically or manually, required information such as, for example, but not limited to,

- wind direction and speed
- HVU name(s), course, speed
- launch platform(s) range from HVU(s), bearing from HVU (S), course, speed,
- threat bearing(s)
- lifetime of air-drifting decoy(s)
- time of flight, separation velocity from launch platform(s) of self-propelled decoy(s)
- distance threshold for air-drifting decoy(s) to pass from HVU(s), for air-drifting decoy to pass from FU/FT, for self-propelled decoy to pass from FU/FT
- time step to analyze air-drifting decoys Continuing to refer to FIGS. 2A-2D, method 150 can also include converting 153 the wind direction to wind drift and Cartesian coordinates to determine how far a parcel of air would move in the x and y direction based on wind speed and direction. Method 150 can also include calculating 155 wind movement in the x and y directions based on wind speed and direction, and calculating 157 HVU movement in the x and y directions based on HVU course and speed. HVU course and speed are converted to Cartesian coordinates and how far the HVU will move in the x and y direction is determined. If 159 there are any incoming threats, method 150 can include calculating 161 the equation of an FU/FT line that runs across the entire domain along the threat bearing, through origin and across the other side, and calculating 163 the series of points along the FU/FT line based on a desired spatial resolution across the entire x domain. Method 150 can include repeating 165 steps 163-187 and 191-205 for each launch platform in the vicinity of the HVU. Method 150 can further include converting 167 the launch platform from range and bearing from the HVU to Cartesian values x and y values relative to the HVU to determine decoy launch locations, and determining 169 decoy drift relative to the HVU frame of reference. Air-drifting decoy location is determined for every time step for the length of the lifetime of the decoy. At time t=0, the decoy is at the launch platform location. For each additional time step, the u and v components of the wind are multiplied times the timestep to determine the displacement, from which is subtracted the motion of the HVU times the timestep to determine the location in an HVU-centered frame of reference. To determine if the decoy cloud passes too close to the HVU, method 150 can include calculating 171 the distance from the HVU for each air-drifting decoy location, and calculating 173, for each launch platform, the minimum distance from any decoy location to the HVU across all time steps. If 175 the calculated minimum distance is below the distance threshold, method 150 can include annotating 177 the launch platform that is too close, for example, but not limited to, by drawing a circle around the launch platform. In addition, a recommendation can optionally be generated if the input received is less than the threshold. For example, text can be concatenated, adding the launch platform name to the words "HOLD (AIR DRIFTING)". If no there is no input received, a message such as "NO (AIR-DRIFTING) RESTRICTIONS" can be used.

Continuing to still further refer to FIGS. 2A-2D, method 150 can even still further include the step of determining 179 how close decoys come from the FU/FT line by calculating, for each air-drifting decoy location, the distance to each point on the FU/FT line. For each air-drifting decoy location, method 150 can include calculating 181 the minimum distance to each point on the FU/FT line for each launch platform, and calculating 183 the minimum distance from any decoy location to FU/FT line. The distances across the time steps can be minimized to determine the minimum distance the decoy passed at any time step from the FU/FT line. If 185 the minimum distance is less than the distance threshold, method 150 can include annotating 187 the launch platform by, for example but not limited to, drawing a circle around the launch platform. Method 150 can also include generating 189 a recommendation if the input received is less than the distance threshold. The recommendation can be created, for example, but not limited to, by concatenating text, adding the platform name to "HOLD (AIR DRIFTING)" string. If no input is received, the message "NO (AIR-DRIFTING) RESTRICTIONS" can be used.

Continuing to even still further refer to FIGS. 2A-2D, method 150 can also include calculating 191 launch platform movement by converting to Cartesian coordinates and determining how far a launch platform can move in the x or y direction. Method 150 can include calculating 193 a self-propelled decoy trajectory based on the separation velocity of the decoy and the time of the decoy flight, calculating x and y displacement over time, and calculating 195 how far the decoy will fly in the x and y direction by adding x and y of launch platform motion to x and y separation velocity per time step and then subtracting HVU x and y motion per time step. Method 150 can include determining how close decoys end up relative to the FU/FT line by, for each self-propelled decoy endpoint location, calculating 197 the distance to each point on the FU/FT line, and, for each self-propelled decoy endpoint location, calculating 199 the minimum distance to each point on the FU/FT line, and, for each launch platform, calculating 201 the minimum distance from the decoy endpoints to FU/FT.

Finally, referring to FIGS. 2A-2D, if 203 the minimum distance is less than the distance threshold, method 150 can include annotating 205 the launch platform by, for example but not limited to, drawing a circle around the launch platform. Method 150 can optionally include generating 207 a recommendation if input received is less than the distance threshold. The recommendation can include, but is not limited to including, concatenating text, adding platform name to "HOLD (SELF PROPELLED)" string. If no input is received, the message "NO (SELF PROPELLED) RESTRICTIONS" can be used. Method 150 can optionally include plotting 209 all features on a display including, but not limited to, launch platform locations, decoy locations, identification of offenders, and recommendations to hold decoys.

Figure 3A:
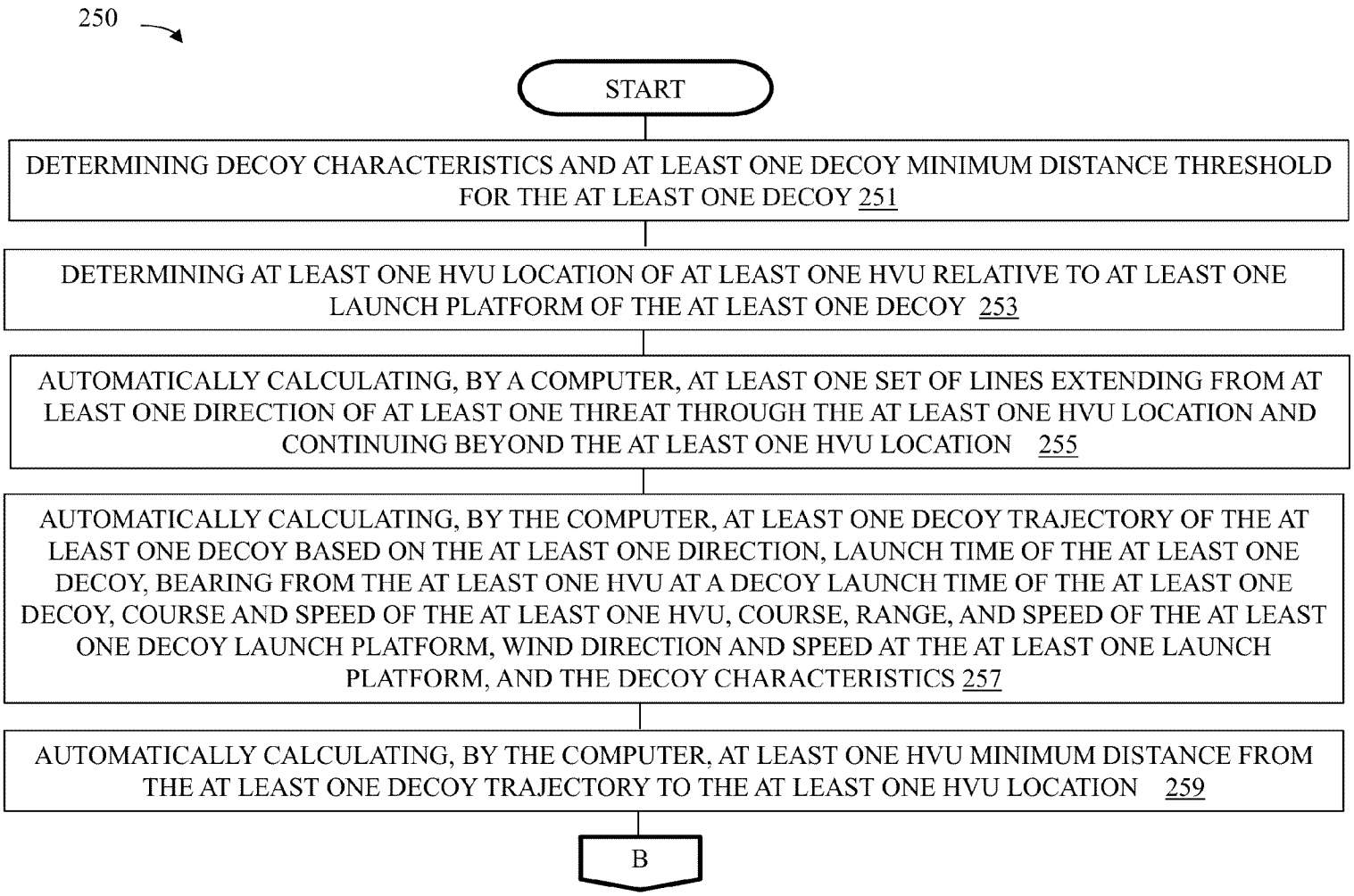
FIGS. 3A-3B are flowcharts of the method of another embodiment of the present teachings.
Figure 3B:
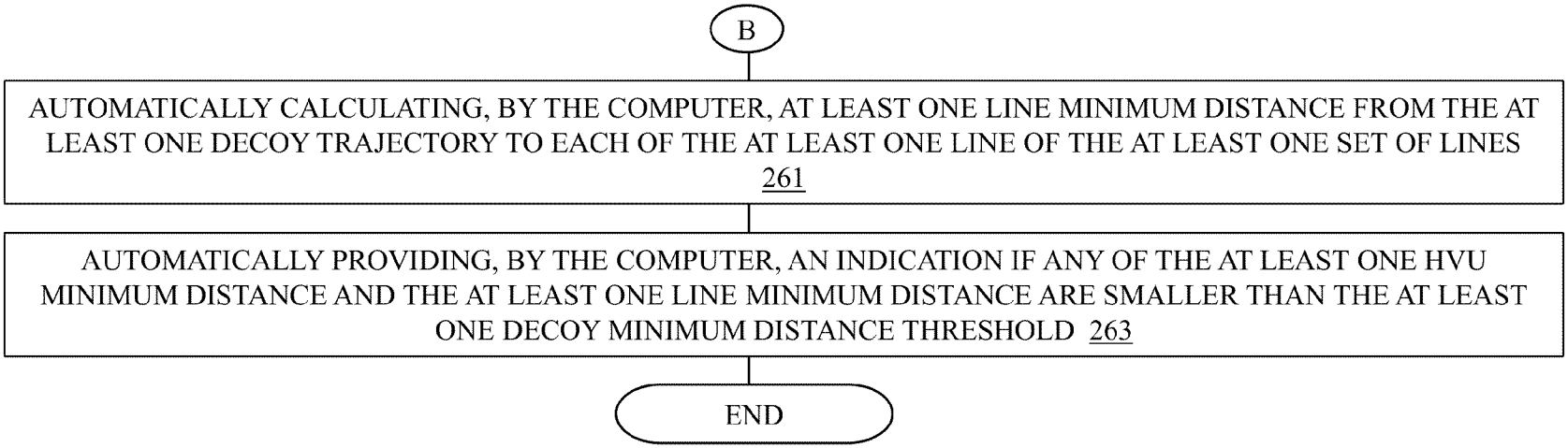

Referring now to FIGS. 3*a*-3b, in another embodiment, method 250 for managing at least one decoy can include, but is not limited to including, determining 251 decoy characteristics and at least one decoy-minimum distance threshold for the at least one decoy, determining 253 at least one hvu location of at least one hvu relative to at least one launch platform of the at least one decoy, automatically calculating 255, by a computer, at least one set of lines extending from at least one direction of at least one threat through the at least one hvu location, and continuing beyond the at least one hvu location, automatically calculating 257, by the computer, at least one decoy trajectory of the at least one decoy based on the at least one direction, launch time of the at least one decoy, bearing from the at least one hvu at a decoy launch time of the at least one decoy, course and speed of the at least one hvu, course, range, and speed of the at least one decoy launch platform, wind direction and speed at the at least one launch platform, and the decoy characteristics, automatically calculating 259, by the computer, at least one hvu minimum distance from the at least one decoy trajectory to the at least one hvu location, automatically calculating 261, by the computer, at least one line minimum distance from the at least one decoy trajectory to each of the at least one line of the at least one set of lines, and automatically providing 263, by the computer, an indication if any of the at least one hvu minimum distance and the at least one line minimum distance are smaller than the at least one decoy-minimum-distance threshold.

Method 250 can optionally include providing a recommendation based on the indication. The recommendation can optionally include a decoy launch recommendation. The decoy can optionally be an air-drifting decoy that is associated with a lifetime and a time of flight. The decoy can optionally be a self-propelled decoy that is associated with a separation velocity. Method 250 can optionally include automatically calculating the decoy trajectory based on a flight trajectory of the self-propelled decoy, determining a threat bearing of the at least one threat, and providing values of the decoy trajectory at pre-selected time intervals. The indication can optionally include a notification to an operator. The notification can optionally include a display including highlighting the decoy launch platform having the HVU minimum distance below the decoy minimum distance threshold. The indication can optionally include an electronic message to the decoy launch platform of the decoy, the decoy launch platform being associated with the HVU minimum distance below the decoy minimum distance threshold.

Figure 4:
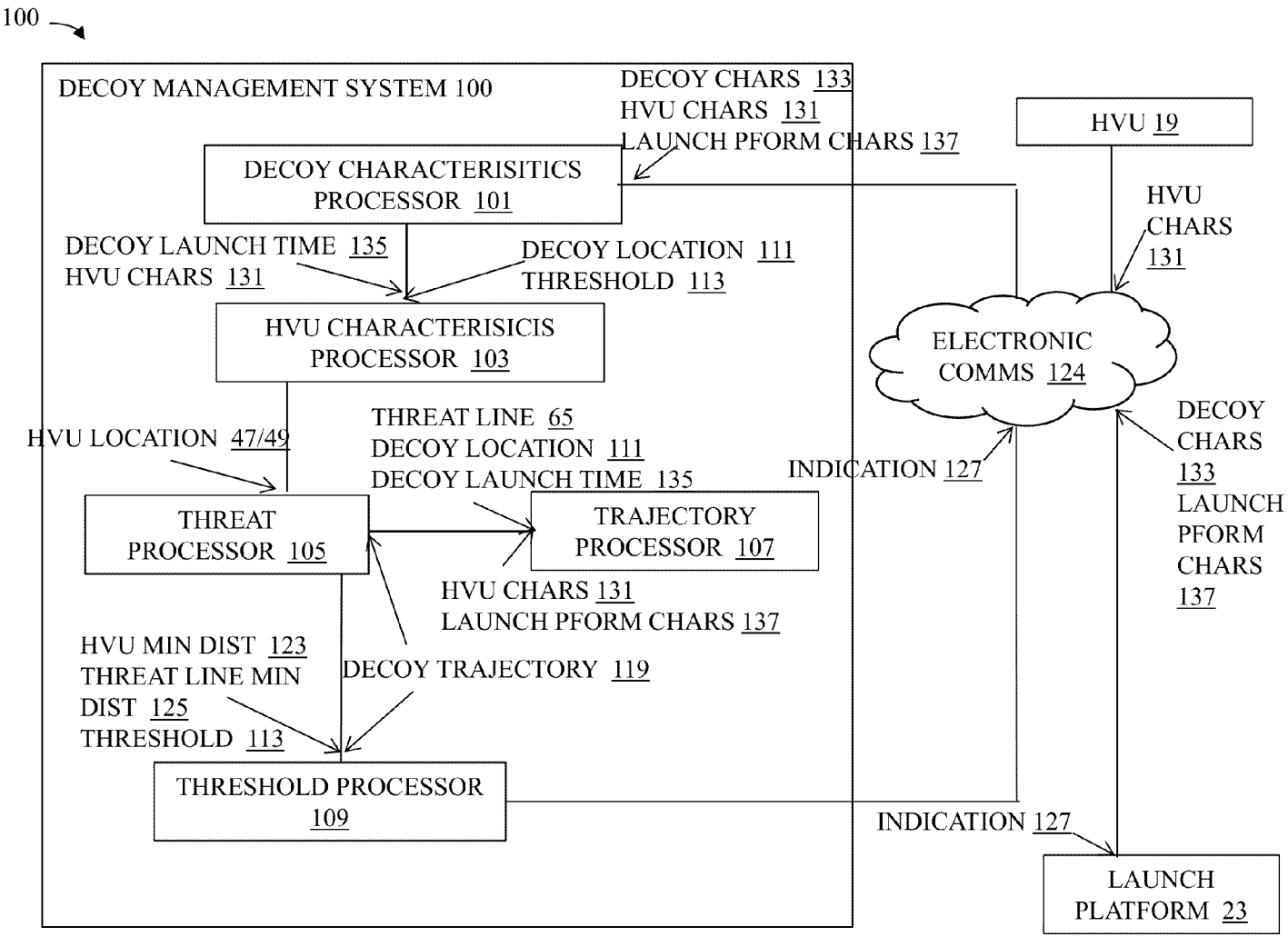
FIG. 4 is a schematic block diagram of the system of the present teachings.

Referring now to FIG. 4, system 100 for managing at least one decoy can include, but is not limited to including, decoy characteristics processor 101 determining decoy characteristics 133 and at least one decoy minimum distance threshold 113 for the at least one decoy, and HVU characteristics processor 103 determining, from HVU characteristics 131, at least one HVU location 47/49 of at least one HVU 19 relative to the location of at least one launch platform 23 of the at least one decoy, the location being determined from launch platform characteristics 137. System 100 can also include threat processor 105 automatically calculating, by a computer, at least one set of lines extending from at least one direction of at least one threat through the at least one HVU location 47/49, and continuing beyond the at least one HVU location 47/49, and trajectory processor 107 automatically calculating, by the computer, at least one decoy trajectory 119 of the at least one decoy based on the at least one direction 111 and launch time 135 of the at least one decoy, bearing from the at least one HVU at a decoy launch time of the at least one decoy, course and speed of the at least one HVU, course, range, and speed of the at least one decoy launch platform, wind direction and speed at the at least one launch platform, and decoy characteristics 133. Threat processor 105 can automatically calculate, by the computer, at least one HVU minimum distance 123 from the at least one decoy trajectory 119 to the at least one HVU location 47/49, automatically calculate, by the computer, at least one line minimum distance 125 from the at least one decoy trajectory 119 to each of the at least one line 65 of the at least one set of lines, and threshold processor 109 automatically providing, by the computer, indication 127 if any of the at least one HVU minimum distance 123 and the at least one line minimum distance 125 are smaller than the at least one decoy minimum distance threshold 113.

Continuing to refer to FIG. 4, threshold processor 109 can optionally provide a recommendation based on indication 127. The recommendation can optionally include a decoy launch recommendation. The decoy can optionally be an air-drifting decoy that is associated with a lifetime and a time of flight. The decoy can optionally be a self-propelled decoy that is associated with a separation velocity. Trajectory processor 107 can optionally automatically calculate decoy trajectory 119 based on a flight trajectory of the self-propelled decoy, and can optionally automatically determine a threat bearing of the at least one threat, and provide values of decoy trajectory 119 at pre-selected time intervals. Indication 127 can optionally include a notification to an operator. The notification can optionally include a display including highlighting decoy launch platform 23 having HVU minimum distance 123 below decoy minimum distance threshold 113. Indication 127 can optionally include an electronic message to decoy launch platform 23 of the decoy, decoy launch platform 23 being associated with HVU minimum distance 123 below decoy minimum distance threshold 113.

In a test environment, system 100 successfully identified vulnerabilities and required mitigations with respect to the laydown and formation of ships during mission planning. During real-time at-sea exercises, system 100 provided watchstander guidance and actionable recommendations regarding decoy management by automatically identifying and highlighting situations of possible fratricide.

Embodiments of the present teachings are directed to computer systems such as system 100 (FIG. 4) for accomplishing the methods such as method 150 (FIGS. 2A-2D) and method 250 (FIGS. 3A-3B) discussed in the description herein, and to computer readable media containing programs for accomplishing these methods. The raw data and results can be stored for future retrieval and processing, printed, displayed, transferred to another computer, and/or transferred elsewhere. Communications links such as electronic communications 124 (FIG. 4) can be wired or wireless, for example, using cellular communication systems, military communications systems, and satellite communications systems. In an exemplary embodiment, the software for the system is written in FORTRAN and C. The system can operate on a computer having a variable number of CPUs. Other alternative computer platforms can be used. The operating system can be, for example, but is not limited to, LINUX®.

The present teachings are also directed to software for accomplishing the methods discussed herein, and computer readable media storing software for accomplishing these methods. The various modules described herein can be accomplished on the same CPU, or can be accomplished on different computers. In compliance with the statute, the present embodiment has been described in language more or less specific as to structural and methodical features. It is to be understood, however, that the present embodiment is not limited to the specific features shown and described, since the means herein disclosed comprise forms of putting the present teachings into effect.

Methods such as method 150 (FIGS. 2A-2D) and method 250 (FIGS. 3A-3B) of the present teachings can be, in whole or in part, implemented electronically. Signals representing actions taken by elements of the system and other disclosed embodiments can travel over at least one live communications network 124 (FIG. 4). Control and data information can be electronically executed and stored on at least one computer-readable medium. System 100 (FIG. 4) can be implemented to execute on at least one computer node in at least one live communications network 124 (FIG. 4). Common forms of at least one computer-readable medium can include, for example, but not be limited to, a floppy disk, a flexible disk, a hard disk, magnetic tape, or any other magnetic medium, a compact disk read only memory or any other optical medium, punched cards, paper tape, or any other physical medium with patterns of holes, a random access memory, a programmable read only memory, and erasable programmable read only memory (EPROM), a Flash EPROM, or any other memory chip or cartridge, or any other medium from which a computer can read. Further, the at least one computer readable medium can contain graphs in any form including, but not limited to, Graphic Interchange Format (GIF), Joint Photographic Experts Group (JPEG), Portable Network Graphics (PNG), Scalable Vector Graphics (SVG), and Tagged Image File Format (TIFF).

Although the present teachings have been described with respect to various embodiments, it should be realized these teachings are also capable of a wide variety of further and other embodiments.

What is claimed is:

1. A computer method for managing at least one decoy comprising:

(a) determining decoy characteristics and at least one decoy-minimum-distance threshold for the at least one decoy;

(b) determining at least one high value unit (HVU) location of at least one HVU relative to at least one launch platform of the at least one decoy;

(c) automatically calculating, by a specially-programmed computer, at least one set of lines extending from at least one direction of at least one threat through the at least one HVU location, and continuing beyond the at least one HVU location;

(d) automatically calculating, by the specially-programmed computer, at least one decoy trajectory of the at least one decoy based on the at least one direction, launch time of the at least one decoy, bearing from the at least one HVU at a decoy launch time of the at least one decoy, course and speed of the at least one HVU, course, range, and speed of the at least one decoy launch platform, wind direction and speed at the at least one launch platform, and the decoy characteristics;

(e) automatically calculating, by the specially-programmed computer, at least one HVU minimum distance from the at least one decoy trajectory to the at least one HVU location;

(f) automatically calculating, by the specially-programmed computer, at least one line minimum distance from the at least one decoy trajectory to each of the at least one line of the at least one set of lines; and (g) automatically providing, by the specially-programmed computer, an indication if any of the at least one HVU minimum distance and the at least one line minimum distance are smaller than the at least one decoy-minimum-distance threshold, wherein the at least one decoy comprises at least one air-drifting decoy, the at least one air-drifting decoy having decoy characteristics including the lifetime of at least one air-drifting decoy, and at least one time of flight of the at least one air-drifting decoy.

2. The method as in claim 1 further comprising:

providing a recommendation based on the indication.

3. The method as in claim 2 wherein the recommendation comprises a decoy launch recommendation.

4. The method as in claim 1 wherein the at least one decoy comprises at least one self-propelled decoy, the at least one self-propelled decoy having decoy characteristics including a separation velocity of the at least one self-propelled decoy.

5. The method as in claim 4 further comprising:

automatically calculating the at least one decoy trajectory based on at least one flight trajectory of the at least one self-propelled decoy.

6. The method as in claim 1 further comprising:

determining a threat bearing of the at least one threat.

7. The method as in claim 1 further comprising:

providing values of the at least one decoy trajectory at pre-selected time intervals.

8. The method as in claim 1 wherein the indication comprises a notification to an operator.

9. The method as in claim 8 wherein the notification comprises a display including highlighting the at least one decoy launch platform having the at least one HVU minimum distance below the at least one decoy-minimum-distance threshold.

10. The method as in claim 1 wherein the indication comprises an electronic message to the at least one decoy launch platform of the at least one decoy, the at least one decoy launch platform being associated with the at least one HVU minimum distance below the at least one decoy-minimum-distance threshold.

11. A computer system for managing at least one decoy comprising:

a decoy characteristics processor, executing on a specially-programmed computer, determining decoy characteristics and at least one decoy-minimum-distance threshold for the at least one decoy;

a HVU characteristics processor, executing on the specially-programmed computer, determining at least one HVU location of at least one HVU relative to at least one decoy launch platform of the at least one decoy;

a trajectory processor automatically calculating, by the specially-programmed computer, at least one decoy trajectory of the at least one decoy based on the at least one direction and launch time of the at least one decoy, bearing from the at least one HVU at a decoy launch time of the at least one decoy, course and speed of the at least one HVU, course, range, and speed of the at least one decoy launch platform, wind direction and speed at the at least one decoy launch platform, and decoy characteristics, a threat processor automatically calculating, by the specially-programmed computer, at least one set of lines extending from at least one direction of at least one threat through the at least one HVU location, and continuing beyond the at least one HVU location, the threat processor automatically calculating, by the computer, at least one HVU minimum distance from the at least one decoy trajectory to the at least one HVU location, the threat processor automatically calculating, by the computer, at least one line minimum distance from the at least one decoy trajectory to each of the at least one line of the at least one set of lines; and a threshold processor automatically providing, by the specially-programmed computer, an indication if any of the at least one HVU minimum distance and the at least one line minimum distance are smaller than the at least one decoy-minimum-distance threshold, wherein the at least one decoy comprises an air-drifting decoy, the air-drifting decoy being associated with a lifetime and a time of flight.

12. The system as in claim 11 wherein the threshold processor comprises:

providing a recommendation based on the indication.

13. The system as in claim 12 wherein the recommendation comprises a decoy launch recommendation.

14. The system as in claim 11 wherein the at least one decoy comprises a self-propelled decoy, the self-propelled decoy being associated with a separation velocity.

15. The system as in claim 11 wherein the trajectory processor comprises:

automatically calculating the at least one decoy trajectory based on a flight trajectory of the self-propelled decoy;

automatically determining a threat bearing of the at least one threat; and providing values of at least one decoy trajectory at preselected time intervals.

16. The system as in claim 11 wherein the indication comprises:

a display including highlighting the decoy launch platform having the HVU minimum distance below the decoy-minimum-distance threshold.

17. The system as in claim 11 wherein the indication comprises:

an electronic message to the decoy launch platform of the decoy, the decoy launch platform being associated with the HVU minimum distance below the decoy-minimum-distance threshold.

* * * * *